US007959204B2

(12) United States Patent
Yoshida

(10) Patent No.: US 7,959,204 B2
(45) Date of Patent: Jun. 14, 2011

(54) ELECTRIC OPENING/CLOSING DEVICE FOR VEHICLE

(75) Inventor: Yasushi Yoshida, Kiryu (JP)

(73) Assignee: Mitsuba Corporation, Gunma (JP)

( * ) Notice: Subject to any disclaimer, the term of this patent is extended or adjusted under 35 U.S.C. 154(b) by 239 days.

(21) Appl. No.: 11/470,514

(22) Filed: Sep. 6, 2006

(65) Prior Publication Data

US 2007/0051046 A1 Mar. 8, 2007

(30) Foreign Application Priority Data

Sep. 7, 2005 (JP) ..... 2005-258869

(51) Int. Cl.
*B62D 25/00* (2006.01)

(52) U.S. Cl. ..... 296/56; 49/341; 49/345

(58) Field of Classification Search ..... 49/340–342, 49/345, 360; 296/146.4, 146.8, 56
See application file for complete search history.

(56) References Cited

U.S. PATENT DOCUMENTS

| | | | | |
|---|---|---|---|---|
| 3,799,005 | A * | 3/1974 | Koehler | 475/12 |
| 4,796,932 | A * | 1/1989 | Tame | 292/112 |
| 5,046,283 | A * | 9/1991 | Compeau et al. | 49/138 |
| 6,055,776 | A * | 5/2000 | Dettling et al. | 49/341 |
| 6,099,430 | A * | 8/2000 | Winks | 475/204 |
| 6,185,868 | B1 * | 2/2001 | Kato | 49/339 |
| 6,202,350 | B1 * | 3/2001 | Montgomery et al. | 49/139 |
| 6,955,390 | B2 * | 10/2005 | Rigorth et al. | 296/146.4 |
| 7,040,473 | B2 * | 5/2006 | Schachtl et al. | 192/84.91 |
| 7,104,589 | B2 * | 9/2006 | Takeda et al. | 296/146.8 |
| 7,201,430 | B2 * | 4/2007 | Sakai et al. | 296/146.8 |
| 7,223,196 | B2 * | 5/2007 | Fruehwald et al. | 475/299 |
| 2004/0245064 | A1 * | 12/2004 | Schachtl et al. | 192/84.961 |
| 2005/0023855 | A1 * | 2/2005 | Omori et al. | 296/56 |
| 2005/0127711 | A1 * | 6/2005 | Rigorth et al. | 296/146.4 |
| 2006/0156630 | A1 * | 7/2006 | Yokomori et al. | 49/360 |

FOREIGN PATENT DOCUMENTS

DE 101 52 697 4/2003

(Continued)

OTHER PUBLICATIONS

"Fixed." The American Heritage® Dictionary of the English Language, Fourth Edition. Houghton Mifflin Company, 2004. Sep. 9, 2009. <Dictionary.com http://dictionary.reference.com/browse/fixed>.*

(Continued)

*Primary Examiner* — Jerry Redman
(74) *Attorney, Agent, or Firm* — J.C. Patents

(57) ABSTRACT

An electric opening/closing device for vehicle, which has good layout characteristic of the vehicle and is provided with a highly-rigid attachment part, is provided. The vehicle electric opening/closing device comprises: a worm wheel meshed with a worm provided on a motor shaft of an electric motor; a planetary gear mechanism disposed coaxially with the worm wheel and decelerating rotation of the worm wheel to transmits it to an output gear; a gear case housing the worm wheel etc. and assembled to the electric motor; and a swing arm rotatably supported by the gear case between an output end linked to a back door and an input end linked to an output gear. An attachment plate for mounting the vehicle electric opening/closing device on the vehicle is sandwiched between the first case body and the second case body which constitute the gear case.

11 Claims, 5 Drawing Sheets

FOREIGN PATENT DOCUMENTS

| | | |
|---|---|---|
| JP | 61-237785 | 10/1986 |
| JP | 01-163386 | 6/1989 |
| JP | 2001-253241 | 9/2001 |
| JP | 2003-221970 | 8/2003 |
| JP | 2005-213762 | 8/2005 |
| JP | 2005-226296 | 8/2005 |

OTHER PUBLICATIONS

Chinese First Examination Report of China Application No. 200610126814.5, dated Aug. 31, 2010, p. 1-3, where the listed reference was cited.

* cited by examiner

ELECTRIC OPENING/CLOSING DEVICE FOR VEHICLE

CROSS-REFERENCE TO RELATED APPLICATIONS

Applicant hereby claims foreign priority benefits under U.S.C. §119 from Japanese Patent Application No. 2005-258869 filed on Sep. 7, 2005, the contents of which are incorporated by reference herein.

BACKGROUND OF THE INVENTION

The present invention relates to an electric opening/closing device for vehicle, which decelerates rotation of an electric motor and transmits it to an opening/closing member that is mounted to a vehicle body and opens/closes an opening portion of a vehicle, thereby opening/closing the opening portion, and particularly relates to an electric opening/closing device for vehicle, which has a worm wheel and a planetary gear mechanism that decelerate the rotation of the electric motor.

The opening/closing member which is mounted to the vehicle body and opens/closes the opening portion of the vehicle includes, for example, a side door, a back door, or a sunroof. For example, in a vehicle such as a wagon or station wagon, an upper-hinge bottom-open type, a so-called lift-up type back door, which is rotatably supported by hinges provided on a roof part of the vehicle body and moves vertically, is mounted, thereby facilitating carrying-in and carrying-out operations of baggage and getting-in and getting-out of people from a rear direction of the vehicle.

In order to reduce labor of carrying out opening/closing movement operations, i.e., movement in an opening direction and a closing direction of the opening/closing member, the electric opening/closing device for vehicle, which opens/closes the opening portion by decelerating the rotation of the electric motor and transmitting it to the opening/closing member, is sometimes mounted on the vehicle such as a passenger automobile. As an example, in a vehicle disclosed in Patent Document 1 (Japanese Patent Laid-Open Publication No. 2001-253241), the rotation of an electric motor is decelerated by a worm gear provided to a motor shaft of the electric motor and thereafter a rack and pinion mechanism is actuated to push/pull a rod, whereby a trunk lid serving as an opening/closing member is moved for opening/closing. As another example, in a vehicle disclosed in Patent Document 2 (Japanese Patent Laid-Open Publication No. 2003-221970), the rotation of the electric motor is decelerated by the worm gear provided to the motor shaft of the electric motor, then further decelerated via a gear train arranged in a parallel axis method, and an arm is pushed and moved by a pin provided on a side surface of an output gear in a protruding manner, whereby a back door serving as an opening/closing member is moved for opening/closing.

SUMMARY OF THE INVENTION

In order to mount, like a technique disclosed in Patent Document 1, the opening/closing device which uses the rack and pinion mechanism capable of moving the opening/closing member for opening/closing by reciprocating the rack, it is necessary to ensure a movement space of the rack, i.e., a clearance corresponding to a movement distance of the rack. Therefore, a problem arises in downsizing the opening/closing device by considering a layout characteristic of the vehicle. As disclosed in Patent Document 2, in the opening/closing device having the gear strain arranged in the parallel axis method, a gear is mounted on each of a plurality of rotation axes disposed in parallel to each other, and the entire device enlarges in a radial direction of the rotation axes. Therefore, like the above-described technique, a problem arises in downsizing the opening/closing device by considering a layout characteristic of the vehicle.

On the other hand, since reaction forces from these opening/closing bodies act on the opening/closing devices which move the opening/closing bodies for opening/closing, the opening/closing devices must be firmly fixed to vehicle bodies by providing attachment parts with high rigidity.

An object of the present invention is to provide an electric opening/closing device for vehicle with a good layout characteristic of the vehicle.

Another object of the present invention is to provide an electric opening/closing device for vehicle in which, without impairing a layout characteristic of the vehicle, an attachment part with high rigidity is provided to firmly fix the opening/closing device to a vehicle body.

An electric opening/closing device for vehicle according to the present invention, in which rotation of an electric motor is decelerated and transmitted to an opening/closing member mounted in a vehicle body and opening/closing an opening portion of the vehicle, the device comprises: a worm wheel meshed with a worm provided on a motor shaft of the electric motor; a planetary gear mechanism disposed coaxially with the worm wheel and decelerating the rotation of the worm wheel to transmit it to a rotating member; a gear case housing the worm wheel, the planetary gear mechanism, and the rotating member and assembled to the electric motor; and a swing arm rotatably supported by the gear case between an input end linked to the rotating member and an output end linked to the opening/closing member and swinging in conjunction with the rotating member to move the opening/closing member for opening/closing.

The electric opening/closing device for vehicle according to the present invention further comprises: a gear part provided in the rotating member; and a sector gear meshed with the gear part and provided in the input end of the swing arm.

The electric opening/closing device for vehicle according to the present invention is such that the planetary gear mechanism is linked to the worm wheel via a power intermittent mechanism of switching to a power transmission state and a power transmission interrupted state.

The electric opening/closing device for vehicle according to the present invention further comprises a linking rod linked to the output end of the arm and the opening/closing member and swinging in conjunction with the swing arm to move the opening/closing member for opening/closing.

The electric opening/closing device for vehicle according to the present invention is such that the opening/closing member, mounted in a rear pillar of the vehicle body and mounted so as to be movable for opening/closing vertically in a rear section of the vehicle, is moved for opening/closing.

An electric opening/closing device for vehicle according to the present invention, in which rotation of an electric motor is decelerated and transmitted to an opening/closing member mounted in a vehicle body and opening/closing an opening portion of the vehicle, comprises: a worm wheel meshed with a worm provided on a motor shaft of the electric motor; a planetary gear mechanism disposed coaxially with the worm wheel and decelerating the rotation of the worm wheel to transmit it to a rotating member; a gear case formed by mutually assembling a first case body housing the worm wheel and a second case body housing the rotating member and the planetary gear mechanism and assembled to the electric motor; and an attachment plate sandwiched between the first case body and the second case body, wherein the attachment plate is fixed to the vehicle body to mount the electric opening/closing device for vehicle on the vehicle body.

The electric opening/closing device for vehicle according to the present invention further comprises a swing arm rotatably supported by the gear case between an input end linked to the rotating member and an output end linked to the opening/closing member and swinging in conjunction with the rotating member to move the opening/closing member for opening/closing.

The electric opening/closing device for vehicle according to the present invention further comprises: a gear part provided in the rotating member; and a sector gear meshed with the gear part and provided in the input end of the swing arm.

The electric opening/closing device for vehicle according to the present invention is such that the planetary gear mechanism is linked to the worm wheel via a power intermittent mechanism of switching to a power transmission state and a power transmission interrupted state.

The electric opening/closing device for vehicle according to the present invention further comprises a linking rod linked to the output end of the arm and the opening/closing member and swinging in conjunction with the swing arm to move the opening/closing member for opening/closing.

The electric opening/closing device for vehicle according to the present invention is such that the opening/closing member, mounted in a rear pillar of the vehicle body and mounted so as to movable for opening/closing vertically in a rear section of the vehicle, is moved for opening/closing.

According to the present invention, the worm wheel and the planetary gear mechanism each of which constitutes a reduction mechanism are disposed coaxially. Thus, as compared with the parallel-axis type reduction mechanism in which a plurality of spur gears are used, radial-directional dimensions can be reduced in size and the entire electric opening/closing device for vehicle can be downsized, thereby making it possible to improve layout characteristic of the vehicle.

According to the present invention, the attachment part for mounting the electric opening/closing device on the vehicle body is provided by being sandwiched between the first case body and the second case body which constitute the gear case, so that the attachment part is sandwiched by a so-called sandwich structure, thereby making it possible to enhance its rigidity. Thus, the electric opening/closing device for vehicle can be firmly fixed to the vehicle body.

According to the present invention, the gear part is provided to the rotating member, and the sector gear meshed with the gear part of the rotating member is provided in the input end of the swing arm. Thus, power transmission can be efficiently carried out by utilizing the meshing of the teeth.

According to the present invention, when the opening/closing member is to be moved by human power, i.e., moved manually for opening/closing, the power intermittent mechanism is switched to the power transmission interrupted state. Thus, the labor required for carrying out manual opening/closing operations can be reduced.

According to the present invention, the swing arm and the opening/closing member are linked by using the linking rod, a link mechanism is formed by the swing arm and the linking rod, and the opening/closing member is moved for opening/closing via the linking rod. Thus, the layout characteristic of the vehicle in the electric opening/closing device for vehicle can be improved.

According to the present invention, there can be provided the preferable electric opening/closing device for vehicle, which is applied to move, for opening/closing, the opening/closing member that can be disposed in the rear pillar of the vehicle with good layout characteristic and is mounted so as to movable for opening/closing vertically in the rear section of the vehicle, for example, a back door.

DESCRIPTION OF THE PREFERRED EMBODIMENTS

Hereinafter, an embodiment of the present invention will be described in detail with reference to the accompanying drawings.

Figure 1:
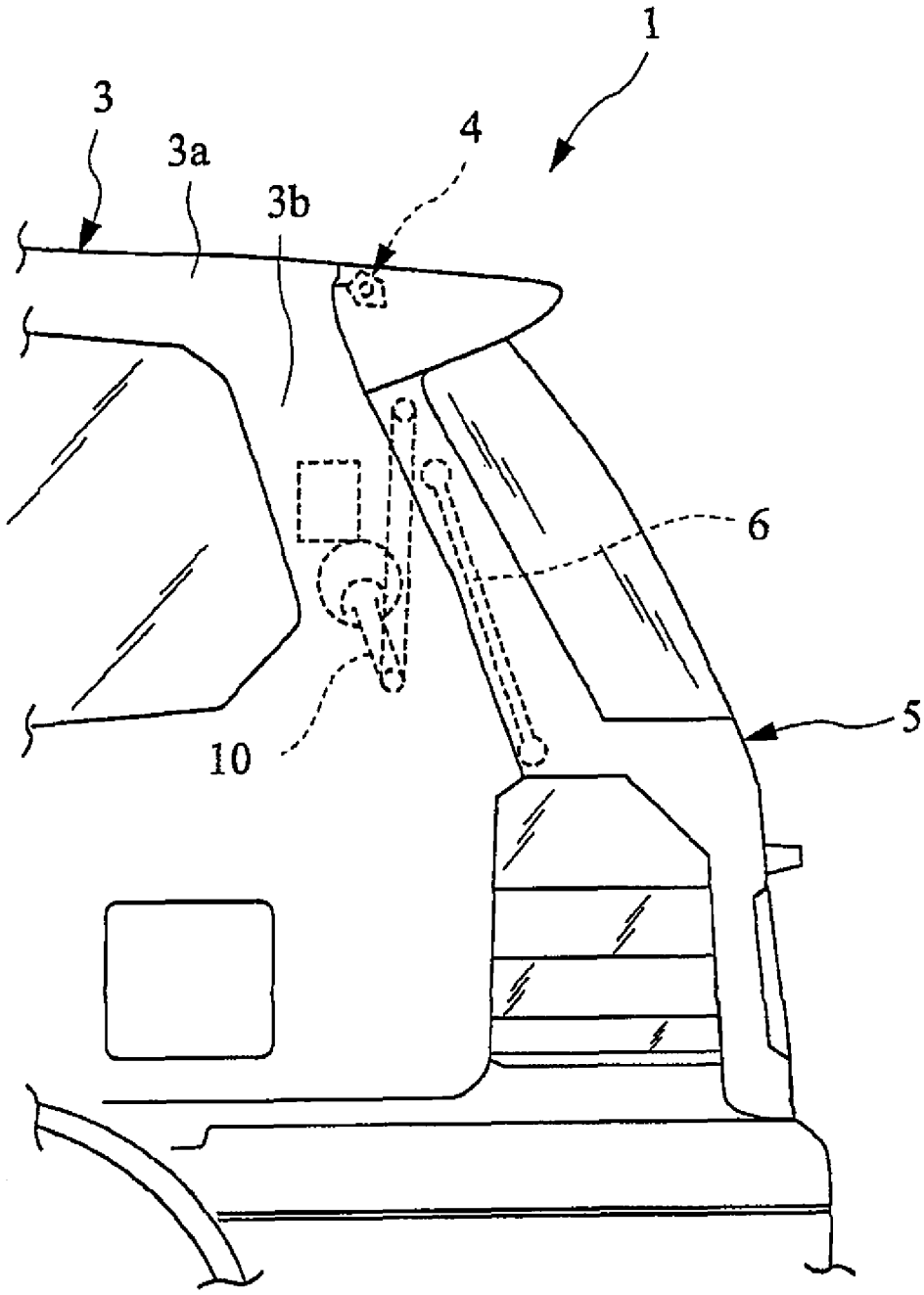
FIG. 1 is a side view showing a rear section of a vehicle in which an electric opening/closing device for vehicle according to an embodiment of the present invention is mounted.
Figure 2:
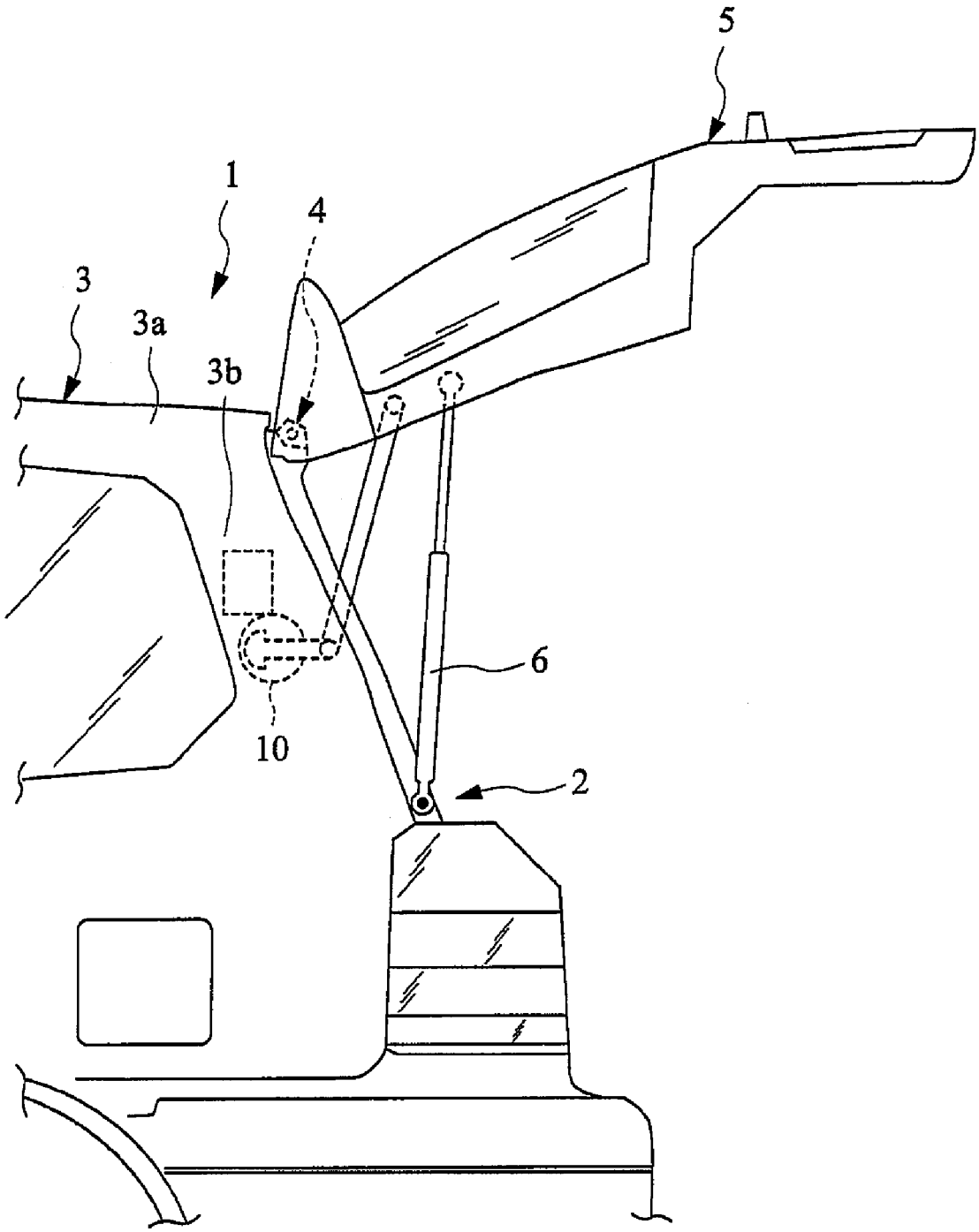
FIG. 2 is a side view showing a state in which a back door is moved to a full-open position in the vehicle shown in FIG. 1.

FIG. 1 is a side view showing a rear section of a vehicle in which an electric opening/closing device for vehicle according to an embodiment of the present invention is mounted, and FIG. 2 is a side view showing a state in which a back door is moved to a full-open position in the vehicle shown in FIG. 1.

An opening portion 2 through which an interior of a vehicle 1 communicates with the outside is provided in a rear section of the vehicle 1, and a back door 5 serving as an opening/closing member is mounted on a roof part 3*a* of a vehicle body 3 via a hinge 4. The back door 5 is an upper-hinge bottom-open type, i.e., a so-called lift-up type, and is rotatable about the hinge 4 serving as a rotation center between a full-closed position where the door is substantially perpendicular as shown in FIG. 1 and a full-open position where the door is substantially horizontal as shown in FIG. 2. In other words, the back door is movable for opening/closing in a vertical direction, so that it becomes possible to facilitate carrying-in and carrying-out operations of baggage and getting-in and getting-out of people from a rear section of the vehicle 1.

In order to reduce labor of carrying out opening/closing operations of the back door 5, i.e., opening/closing movement thereof in a opening direction and a closing direction, an electric opening/closing device for vehicle 10 (hereinafter, arbitrarily referred to as an "opening/closing device 10") according to an embodiment of the present invention is mounted in a rear pillar 3*b* of the vehicle body 3 so that the opening portion 2 is opened/closed by decelerating rotation of an electric motor and transmitting it to the back door 5.

A gas stay 6 serving as an open auxiliary force generating means is mounted between the back door 5 and the vehicle body 3. Therefore, when the back door 5 is opened at a predetermined open degree or more, the gas stay 6 extends due to an internal gas pressure and biases the back door 5 in an opening direction. Consequently, due to such a bias force, the labor of carrying out the opening/closing operations is reduced and the back door 5 is retained at the full-open position. Inversely, when the back door 5 is closed to the predetermined open degree or less, the bias force applied by the gas stay 6 is less than weight of the back door 5 per se and the back door 5 moves in a closing direction. Note that, instead of the gas stay 6, a torsion bar may be used as the open auxiliary force generating means.

Figure 3:
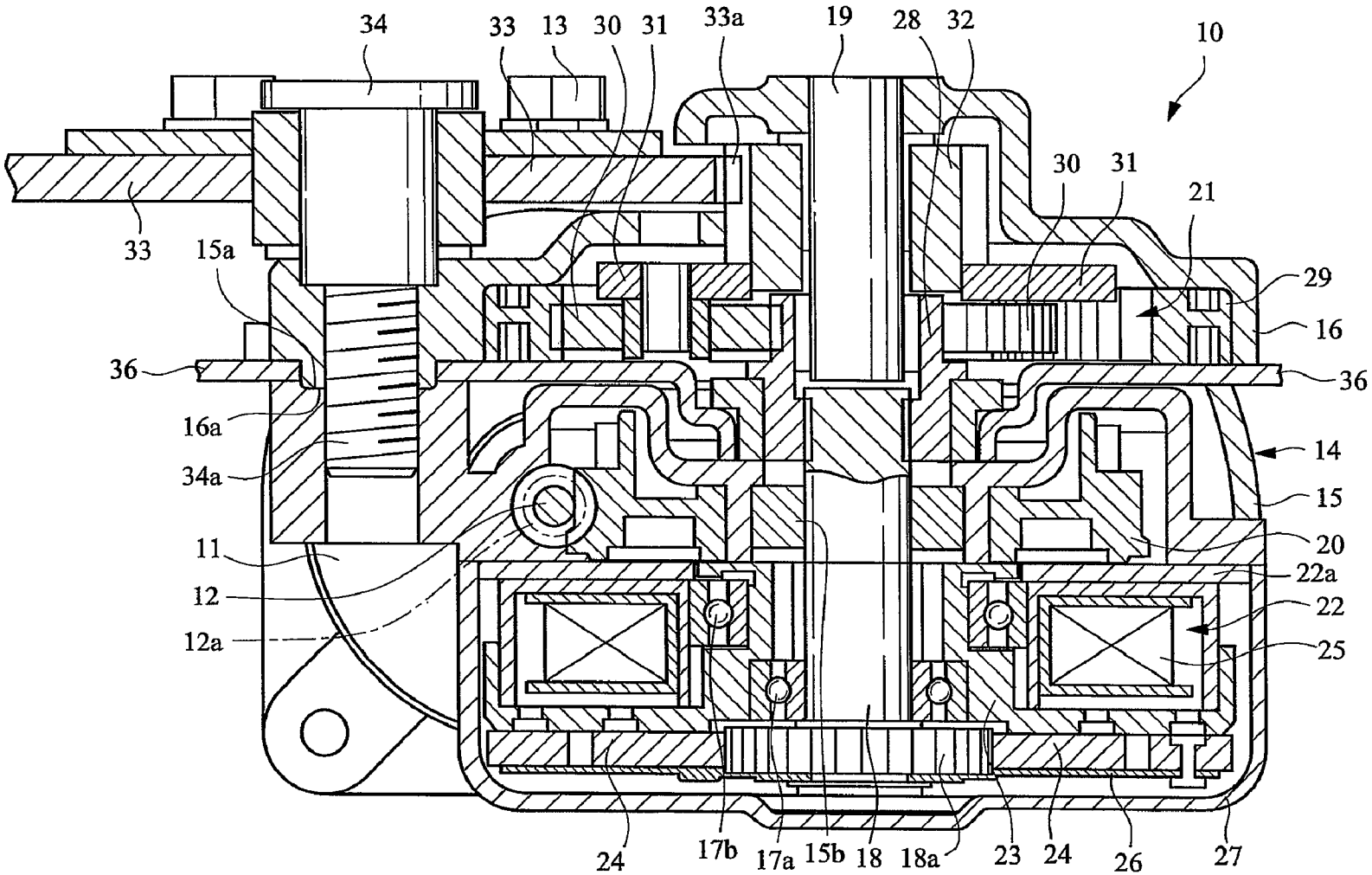
FIG. 3 is a cross-sectional view showing an internal structure of the electric opening/closing device for vehicle according to the embodiment of the present invention.
Figure 4:
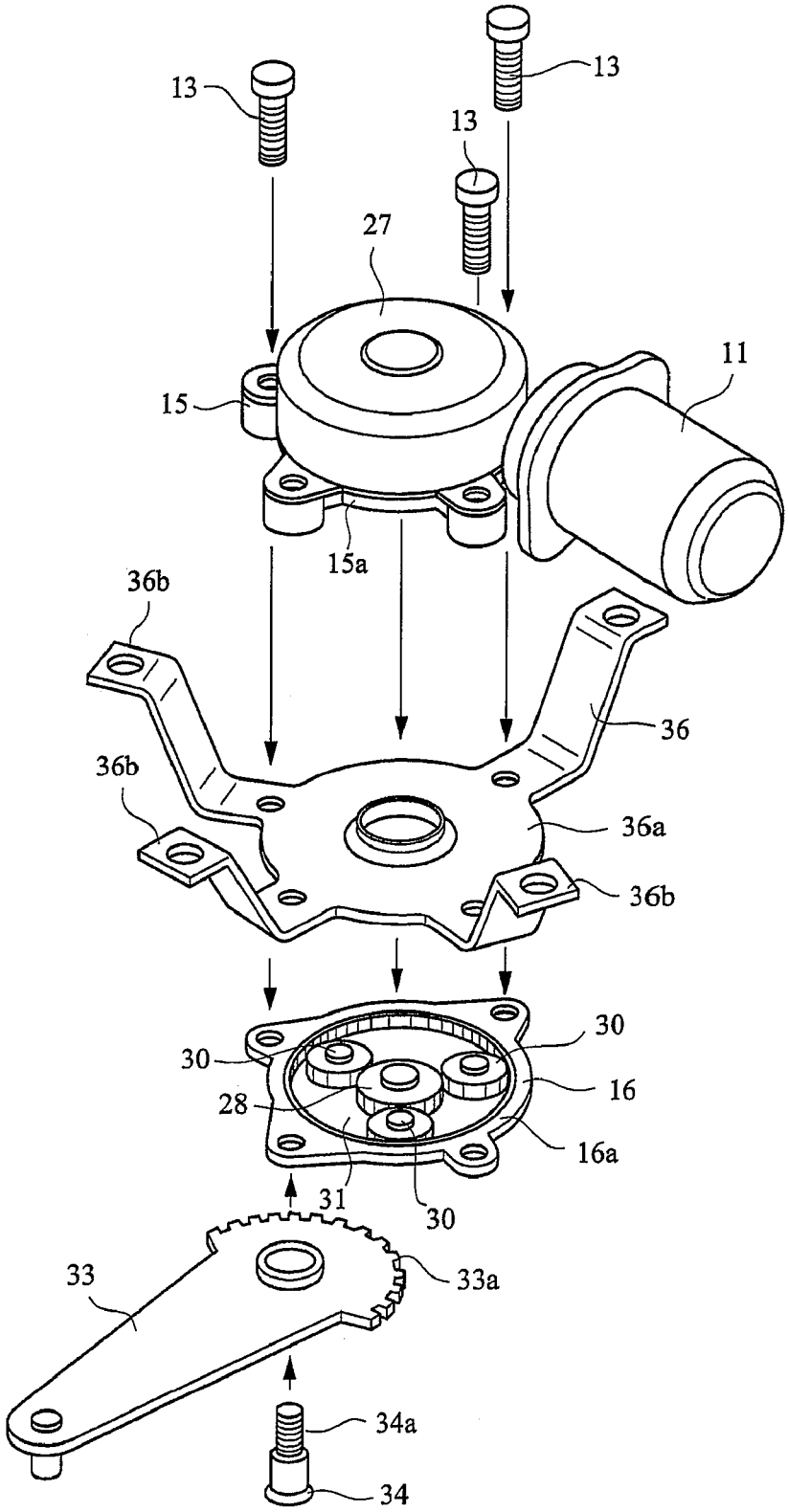
FIG. 4 is an exploded perspective view of the electric opening/closing device for vehicle shown in FIG. 3.
Figure 5:
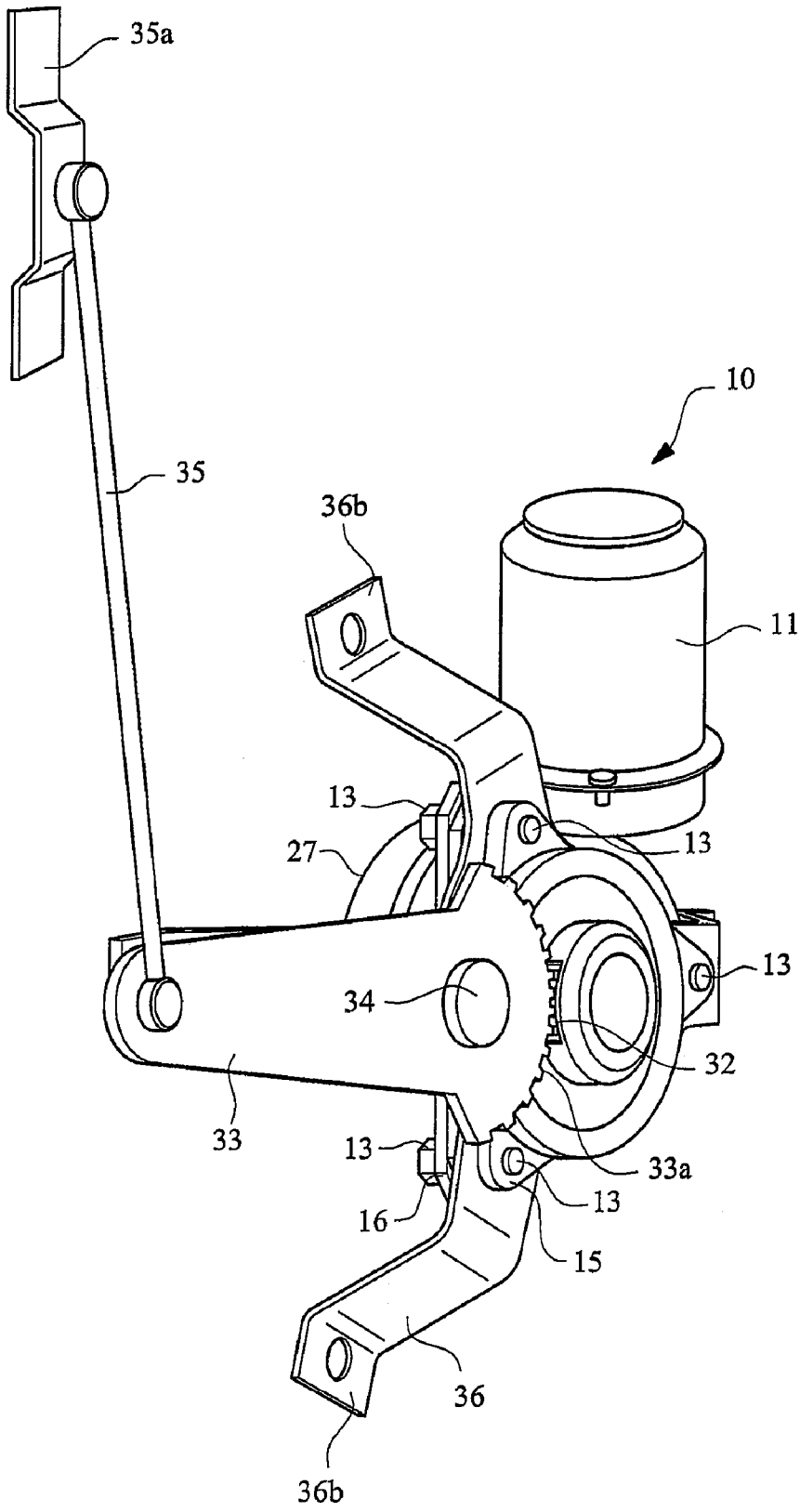
FIG. 5 is a perspective view showing an assembled state of the electric opening/closing device for vehicle shown in FIG. 4.

FIG. 3 is a cross-sectional view showing an internal structure of the electric opening/closing device for vehicle according to the embodiment of the present invention; FIG. 4 is an exploded perspective view of the electric opening/closing device for vehicle shown in FIG. 3; and FIG. 5 is a perspective view showing an assembled state of the electric opening/closing device for vehicle sown in FIG. 4. A worm 12*a* is integrally provided on an outer circumference of a motor shaft 12 in an electric motor 11 serving as a drive source of the opening/closing device 10, and the motor shaft 12 can reversibly rotate by current-carrying control to the electric motor 11.

The opening/closing device 10 has a first case body 15 and a second case body 16, which constitute a gear case 14 by using a plurality of screw members 13 to be assembled to each other. The electric motor 11 is assembled to the gear case 14 in a state in which a tip of the motor shaft 12, i.e., the worm 12*a* is inserted in the gear case 14. In the gear case 14, a rotation shaft 18 which is rotatably supported via a bearing 15*b* and a support shaft 19 which is disposed coaxially with the rotation shaft 18 and fixed to the gear case 14 are incorporated.

A worm wheel 20 meshed with the worm 12*a* is mounted relatively rotatably on the rotation shaft 18, whereby the worm 12*a* and the worm wheel 20 form a worm gear as a reduction mechanism. A planetary gear mechanism 21 serving as a reduction mechanism is mounted relatively rotatably on the support shaft 19, whereby the planetary gear mechanism 21 is configured to be disposed coaxially with the worm wheel 20.

The rotation of the motor shaft 12 is decelerated by the worm gear, in other words, rotational torque is amplified and transmitted. The planetary gear mechanism 21 is linked to the worm wheel 20 via a power intermittent mechanism which intermits a power transmission path by switching to a power transmission state and a power transmission interrupted state. In the power transmission state, the rotation of the worm wheel 20 is transmitted to the planetary gear mechanism 21. When the back door 5 is to be opened/closed manually, labor required for manual operations can be reduced by switching to the power transmission interrupted state.

The power intermittent mechanism in the present embodiment is a friction-type electromagnetic clutch 22 comprising: a drive rotor 23 which is mounted relatively rotatably on a clutch coil 25 by a bearing 17*b* as described below and mounted relatively rotatably on the rotation shaft 18 by the bearing 17*b* and rotates integrally with the worm wheel 20; an armature plate 24 which is engaged with a serration part 18*a* provided on an outer circumferential surface of the rotation shaft 18, thereby rotating in conjunction with the rotation shaft 18 and being movable in an axial direction; and a clutch coil 25 which is fixed to the first case body 15 by a retention plate 22*a* and generates a magnetic attraction force for engaging the armature plate 24 with the drive motor 23. A plate spring 26, which is mounted on a base end of the rotation shaft 18, is attached to the armature plate 24. Due to a spring force of the plate spring 26, the armature plate 24 is always biased in a direction of being detached from the drive rotor 23. When electric power is not supplied to the clutch coil 25, the armature plate is retained at a non-engagement position of not being engaged with the drive rotor 23.

The armature plate 24 is formed of a magnetic substance such as steel. When electric power is supplied to the clutch coil 25 to generate the magnetic attraction force in the clutch coil 25, the armature plate 24 is attracted by the magnetic attraction force to a position where the armature plate 24 is engaged with the drive rotor 23 against the spring force of the plate spring 26 and the rotation of the worm wheel 20 is transmitted to the planetary gear mechanism 21 via the drive rotor 23, the armature plate 24, and the rotation shaft 18. Meanwhile, when supply of the electric power to the clutch coil 25 is stopped, the armature plate 24 moves to a position of not being engaged with the drive rotor 23. In the above-described manner, by the current-carrying control to the clutch coil 25, the electromagnetic clutch 22 serving as the power intermittent mechanism can be switched to the power transmission state and the power transmission interrupted state. The electro-magnetic clutch 22 is covered by a case cover 27 which is assembled to the first case body 15.

In the present embodiment, the planetary gear mechanism 21 is a so-called single pinion type and comprises: a sun gear 28 which is meshed with the tip end of the rotation shaft 18; a ring gear 29 which is fixed to the second case body 16; a plurality of planetary gears 30 which are disposed between the sun gear 28 and the ring gear 29 and rotate on an axis of the sun gear 28 while revolving about the sun gear 28; and a carrier 31 which retains each of the planetary gears 30 equally spaced in a circumferential direction. An output gear 32, serving as a rotating member which is mounted relatively rotatably on the support shaft 19, is fixed to the carrier 31. Since the rotation of the rotation shaft 18 is inputted from the sun gear 28 and outputted from the carrier 31, it is reduced to a value equal to or less than a predetermined value and transmitted to the output gear 32.

The worm wheel 20 and the planetary gear mechanism 21 each of which constitutes a reduction mechanism are arranged coaxially in the above-described manner. Therefore, as compared with a parallel-axis type reduction mechanism using a plurality of spur gears, radial-directional dimensions can be reduced in size and the entire device can be downsized, whereby the layout characteristic of the vehicle is improved. Accordingly, compact mounting of the device can be carried out, for example, even in the pillar 3*b*. As shown in FIG. 4, constituent members such as the planetary gear mechanism 21 and a swing arm 33 which constitute the opening/closing device 10 can be assembled according to a stacking method.

In the present embodiment, the sun gear 28 serves as an input element and the carrier 31 serves as an output element. However, needless to say, the present embodiment is not limited to them and may employ various speed-change configurations, which can be generally selected when the planetary gear mechanism 21 is used as a reduction mechanism. For example, the sun gear 28 and the ring gear 29 may serve as an input element and an output element, respectively. In this case, in a state in which the sun gear 28 is meshed with the rotation shaft 18, the carrier 31 is fixed to the second case body 16 and the output gear 32 is fixed to the ring gear 29. A so-called double pinion type planetary gear mechanism can be also used.

The outer circumference of the output gear 32 is provided with a gear part, and the gear part of the output gear 32 is meshed with the swing arm 33. The swing arm 33 is a plate-like swing member having an input end at one end and an output end at the other end. The input end is provided with a sector gear, in which a plurality of tooth parts 33*a* meshed with the gear part of the output gear 32 are arranged in a fan-like form. A substantially middle part of the swing arm 33 is rotatably attached to a swing shaft 34 having a screw part

34*a* which assembles the first case body 15 and the second case body 16 to each other. Consequently, the swing arm 33 is rotatably supported by the gear case 14.

The above-mentioned swing arm 33 is linked to the planetary gear mechanism 21 via the output gear 32, thereby swings about a shaft center of the swing shaft 34 serving as a rotation center in conjunction with the rotation of the output gear 32. The sector gear meshed with the gear part of the output gear 32 is provided to the input end of the swing arm 33, whereby power transmission can be effectively carried out by using meshing of the teeth to transmit the rotation power. Note that the output gear 32 is merely one embodiment as a rotating member for transmitting the rotation output of the planetary gear mechanism 21 to the swing arm 33. Alternatively, instead of the output gear, power may be transmitted without providing the sector gear by forming rolling surfaces, which come into contact with each other, on the input end of the swing arm 33 and the rotating member and by utilizing rolling friction.

As shown in FIG. 5, a linking rod 35 is rotatably mounted to the output end of the swing arm 33 by a ball-joint type linking means, and a fixing part 35*a* for fixing the linking rod 35 to the back door 5 is provided to a tip portion of the linking rod 35. Therefore, the linking rod 35 and the swing arm 33 constitute a link mechanism which moves the back door 5 to rotate about the hinge 4 serving as a rotation center. By using the linking rod 35, the opening/closing device 10 can be mounted with a good layout characteristic of the vehicle.

In the present embodiment, the opening/closing device 10 has an attachment plate 36 as an attachment part for mounting the device on the vehicle body 3. The attachment plate 36 comprises an annular insertion part 36*a*, and flange parts 36*b* which are provided to a outer circumference of the insertion part 36*a* and radially extend outward.

When the first case body 15 and the second case body 16 are assembled with each other, the insertion part 36*a* of the attachment plate 36 is incorporated so as to be sandwiched between abutment surfaces 15*a* and 16*a* of the case bodies which are abutted on each other, in other words, so that one surface of the insertion part 36*a* contacts with the abutment surface 15*a* and the other surface thereof contacts with the abutment surface 16*a* and thereby both surfaces of the insertion part 36*a* can contact with the abutment surfaces 15*a* and 16*a*. Thus, the attachment plate 36 serving as an attachment part provided in the opening/closing device 10 has high rigidity since being sandwiched by a sandwich structure. Therefore, the opening/closing device 10 which can be firmly fixed to the vehicle body 3 via the attachment plate 36 has a structure capable of being satisfactorily durable even when the reaction force from the back door 5 acts thereon.

As described above, in the opening/closing device 10 of the present invention, the attachment part with respect to the vehicle body 3 is taken into consideration in advance. Specifically, the attachment plate 36 serving as the attachment part can be provided in the opening/closing device 10 without using any dedicated fastening tools such as screw members for merely providing the attachment plate 36. Therefore, weight can be reduced as compared with the case where a bracket serving as an attachment part is attached later to the unitized opening/closing device by using dedicated fastening tools such as screw members.

Conventionally, in the case where the bracket serving as an attachment part is attached afterward by using the dedicated fastening tools, the attachment part is not sufficient in rigidity. This is because: the bracket is provided via the fastening tools; ribs for ensuring the rigidity have to be formed at many parts; and a type of the electric motor 11 mounted in the opening/closing device 10 is limited to those which can avoid interference with the ribs. However, according to the present invention, since the ribs for providing the attachment part are not required to be formed, various types of electric motors can be mounted, whereby high versatility can be achieved.

The present invention is not limited to the above-described embodiments and, needless to say, can be altered and modified within the scope of not departing from the gist thereof. For example, in the present embodiment, the opening/closing member for vehicle is the back door 5 provided to a rear end of the vehicle 1. However, the opening/closing member is not limited thereto and, for example, may be a trunk lid provided in a sedan car or the like.

What is claimed is:

1. An electric opening/closing device for a vehicle, in which rotation of an electric motor is decelerated and transmitted to an opening/closing member mounted in a vehicle body and opening/closing an opening portion of the vehicle, the device comprising:

a worm wheel meshed with a worm provided on a motor shaft of the electric motor;

a planetary gear mechanism disposed coaxially with the worm wheel and decelerating the rotation of the worm wheel to transmit the rotation to an output gear;

a gear case housing the worm wheel, a rotation shaft which mounts the worm wheel in a manner that the worm wheel is rotatable relative to the rotation shaft, the planetary gear mechanism, a support shaft which is disposed coaxially with the rotation shaft and fixed to the gear case and which mounts the planetary gear mechanism and the output gear in a manner that the planetary gear mechanism and the output gear are rotatable relative to the support shaft, and the output gear and assembled to the electric motor; and a swing arm having an input end and an output end and rotatably supported by the gear case through a swing shaft disposed between the input end linked to the output gear and the output end linked to the opening/closing member, and the swing arm includes a sector gear formed on an outer edge of the input end, and the sector gear meshed with the output gear such that the swing arm swings in conjunction with the output gear to move the opening/closing member for opening/closing.

2. The electric opening/closing device for vehicle according to claim 1, wherein the planetary gear mechanism is linked to the worm wheel via a power intermittent mechanism of switching to a power transmission state and a power transmission interrupted state.

3. The electric opening/closing device for vehicle according to claim 1, further comprising a linking rod linked to the output end of the swing arm and the opening/closing member and swinging in conjunction with the swing arm to move the opening/closing member for opening/closing.

4. The electric opening/closing device for vehicle according to claim 1, wherein the opening/closing member, mounted in a rear pillar of the vehicle body and mounted so as to be movable for opening/closing vertically in a rear section of the vehicle, is moved for opening/closing.

5. An electric opening/closing device for a vehicle, in which rotation of an electric motor is decelerated and transmitted to an opening/closing member mounted in a vehicle body and opening/closing an opening portion of the vehicle, the device comprising:

a worm wheel meshed with a worm provided on a motor shaft of the electric motor;

a planetary gear mechanism disposed coaxially with the worm wheel and decelerating the rotation of the worm wheel to transmit the rotation to an output gear;

a gear case formed by mutually assembling a first case body housing the worm wheel and a rotation shaft which mounts the worm wheel in a manner that the worm wheel is rotatable relative to the rotation shaft and a second case body housing the output gear, the planetary gear mechanism and a support shaft which is disposed coaxially with the rotation shaft and fixed to the gear case and which mounts the planetary gear mechanism and the output gear in a manner that the planetary gear mechanism and the output gear are rotatable relative to the support shaft and assembled to the electric motor; and an attachment plate sandwiched between the first case body and the second case body, and a swing arm having an input end and an output end and rotatably supported by the gear case through a swing shaft disposed between the input end linked to the output gear and the output end linked to the opening/closing member, and the swing arm includes a sector gear formed on an outer edge of the input end, and the swing arm swings in conjunction with the output gear to move the opening/closing member for opening/closing, wherein the attachment plate is fixed to the vehicle body to mount the electric opening/closing device for the vehicle on the vehicle body.

6. The electric opening/closing device for vehicle according to claim 5, further comprising: a gear part provided in the output gear; and the sector gear meshed with the gear part.

7. The electric opening/closing device for vehicle according to claim 6, wherein the planetary gear mechanism is linked to the worm wheel via a power intermittent mechanism of switching to a power transmission state and a power transmission interrupted state.

8. The electric opening/closing device for vehicle according to claim 6, wherein the opening/closing member, mounted in a rear pillar of the vehicle body and mounted so as to movable for opening/closing vertically in a rear section of the vehicle, is moved for opening/closing.

9. The electric opening/closing device for vehicle according to claim 5, wherein the planetary gear mechanism is linked to the worm wheel via a power intermittent mechanism of switching to a power transmission state and a power transmission interrupted state.

10. The electric opening/closing device for vehicle according to claim 5, further comprising a linking rod linked to the output end of the swing arm and the opening/closing member and swinging in conjunction with the swing arm to move the opening/closing member for opening/closing.

11. The electric opening/closing device for vehicle according to claim 5, wherein the opening/closing member, mounted in a rear pillar of the vehicle body and mounted so as to movable for opening/closing vertically in a rear section of the vehicle, is moved for opening/closing.

* * * * *